US005392201A

United States Patent [19]

Morley et al.

[11] Patent Number: 5,392,201

[45] Date of Patent: Feb. 21, 1995

[54] ROLLING MECHANIC'S LAMP

[76] Inventors: Robert M. Morley; Mitchell E. Morley, both of 7477 Windgate Ct., Riverdale, Ga. 30274

[21] Appl. No.: 188,699

[22] Filed: Jan. 31, 1994

[51] Int. Cl.[6] ..... F21V 15/02; F21V 33/00

[52] U.S. Cl. ..... 362/61; 362/376

[58] Field of Search ..... 362/61, 185, 191, 217, 362/200, 222, 376

[56] References Cited

U.S. PATENT DOCUMENTS

| | | | |
|---|---|---|---|
| 1,648,709 | 11/1927 | Winsell | 362/191 |
| 2,291,094 | 7/1942 | McCarthy | 362/61 |
| 2,580,699 | 1/1952 | Pfetzing | 362/61 |
| 3,936,668 | 2/1976 | Siebel | 362/61 |
| 4,042,819 | 8/1977 | Dacal | 362/222 |
| 4,232,357 | 11/1980 | Dietz | 362/191 |
| 4,698,731 | 10/1987 | Johns, Sr. | 362/61 |
| 4,935,854 | 6/1990 | Kernodle | 362/61 |
| 5,243,507 | 9/1993 | Atkins et al. | 362/310 |

*Primary Examiner*—Ira S. Lazarus

*Attorney, Agent, or Firm*—Rhodes & Ascolillo; David L. Baker

[57] ABSTRACT

A rolling mechanic's lamp is disclosed. The lamp is provided with a rectangular frame member having a centrally located opening and two receptacles remote therefrom for carrying small tools and the like. A reflector is secured to the frame member for directing light through the top of the opening. An electric bulb, capable of illuminating the area above the frame member when energized, is supported by the reflector within the opening. A cage is secured to the top of the frame member and disposed above the bulb. The cage includes a ring fitted about the periphery of the opening and a number of arches having their respective lower ends joined to the ring in a spaced apart relationship and having their respective upper ends joined together at a predetermined height above the opening. A caster is secured to each of the four corners of the frame member. A handle is joined to one side of the frame member for grasping by the human hand and movement of the lamp from place to place.

4 Claims, 2 Drawing Sheets

ROLLING MECHANIC'S LAMP

BACKGROUND OF THE INVENTION

1. Field of the Invention

The present invention relates generally to portable light sources and, more particularly, pertains to a lamp having casters for movement over a floor surface.

2. Description of the Related Art

U.S. Pat. No. 4,698,731, issued Oct. 6, 1987 to Frederick W. Johns, Sr., shows a lamp secured to the head of a mechanic's creeper. The position of the lamp may not be modified without the mechanic moving his entire body.

U.S. Pat. No. 4,935,854, issued Jun. 19, 1990 to Gerald W. Kernodle, on the other hand, provides a lamp having a telescoping feature for illuminating the undercarriage of a vehicle that has been raised on a garage lift. Because of its substantial height even when in its retracted position, this particular device is not well suited for use in areas with extremely low overhead clearance. A need, therefore, exists for a mechanic's lamp which may be moved without a great expenditure of effort and which may utilized in areas of low overhead clearance.

SUMMARY OF THE INVENTION

For decades, amateur and professional mechanics have struggled beneath automobiles with battery-operated flashlights. It is, of course, well known that these devices produce limited amounts of light focused in a tight beam, increasing visibility in the dark and confined areas of an automobile undercarriage only to a slight degree. Furthermore, the clumsy shape of most flashlights makes them difficult to utilize when both of the mechanic's hands are required to manipulate a tool or automobile component to accomplish a given repair task.

Accordingly, it is a principal object of the present invention to provide a mechanic's lamp which is easily mobile and which allows a mechanic to work freely with both hands.

It is an additional object of the invention to provide a lamp of the type described which provides a sufficient amount of light to the dark and confined areas of an automobile undercarriage.

The present invention achieves the above objects, among others, by providing in one aspect a rolling mechanic's lamp having a frame member with a centrally located opening and at least one receptacle remote therefrom for article carrying purposes. There is an illumination source for lighting the area above the frame member, positioned within the opening. A cage is secured to the top of the frame member and is disposed above the opening, while a plurality of casters is secured to the frame member.

Preferably, the illuminating source includes a reflector secured to the frame member for directing light through the top of the opening and an electric bulb supported by the reflector within the opening. The electric bulb may be of fluorescent type or the incandescent type. The cage consists of a ring fitted about the periphery of the opening and a plurality of arches having their respective lower ends joined to the ring in a spaced apart relationship and having their respective upper ends joined together at a predetermined height above the opening. Additionally, the frame member is rectangular in configuration and further includes one of the plurality of casters secured to each of the four corners thereof. Finally, a handle is joined to the frame member and adapted for grasping by the human hand.

In another aspect, the invention generally provides a rolling mechanic's lamp having a rectangular frame member with a centrally located opening and at least one receptacle remote therefrom for article carrying purposes. A reflector is secured to the frame member in the centrally located opening for directing light through the top of the opening. An electric bulb is supported by the reflector within the opening for illuminating the area above the frame member. There is a cage secured to the top of the frame member and disposed above the electric bulb, with the cage further including a ring fitted about the periphery of the opening and a plurality of arches having their respective lower ends joined to the ring in a spaced apart relationship and having their respective upper ends joined together at a predetermined height above the opening. Finally, a caster secured to each of the four corners of the frame member, and a handle is joined to the frame member adapted for grasping by the human hand.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
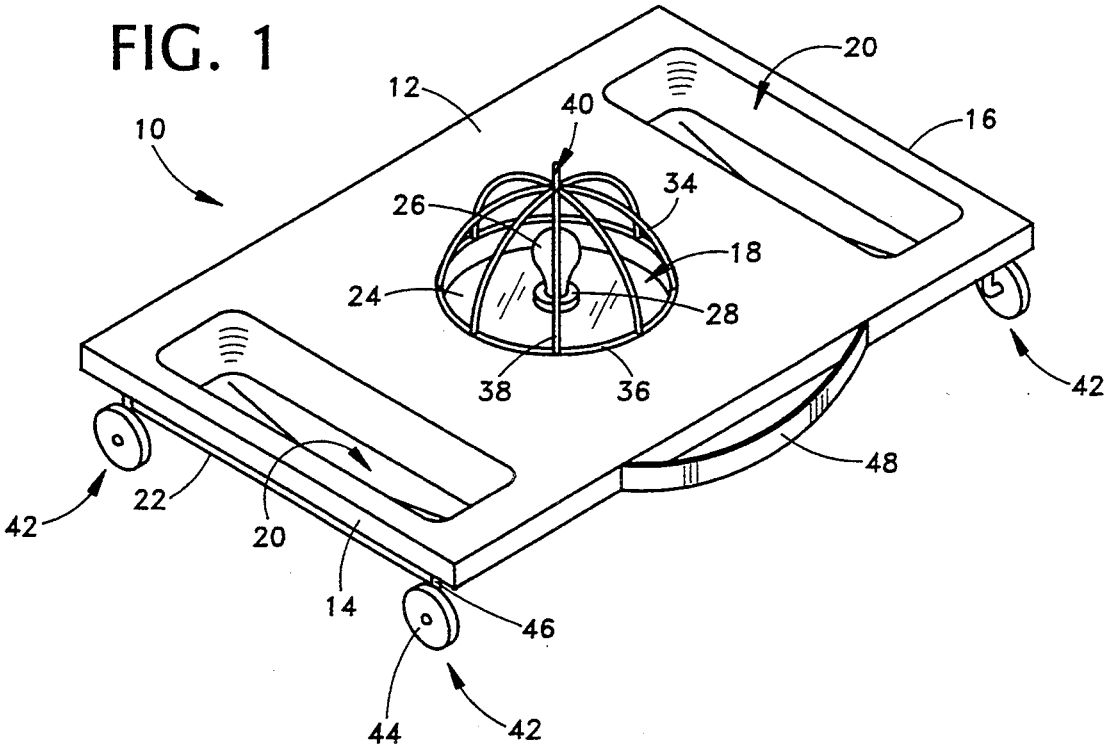
FIG. 1 is a perspective view of a rolling mechanic's lamp in accordance with the present invention.
Figure 2:
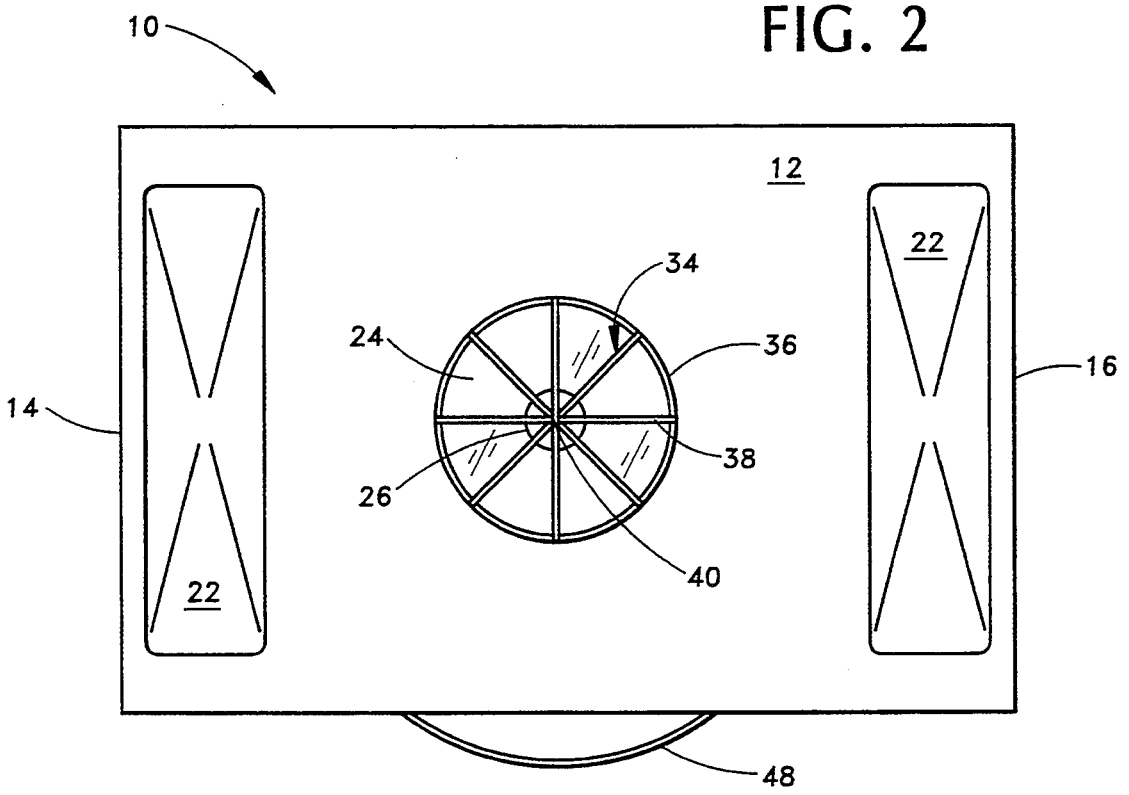
FIG. 2 is a top plan view of the mechanic's lamp of FIG. 1.
Figure 3:
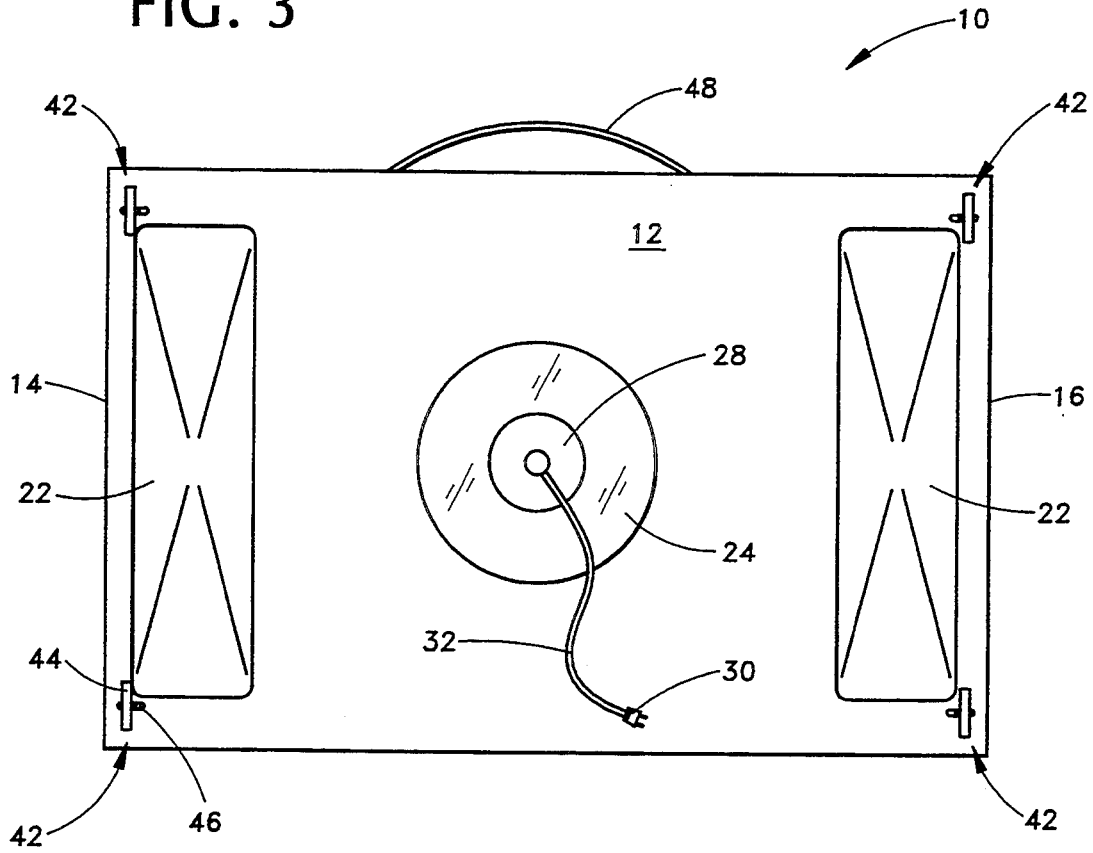
FIG. 3 is a bottom plan view of the mechanic's lamp.
Figure 4:
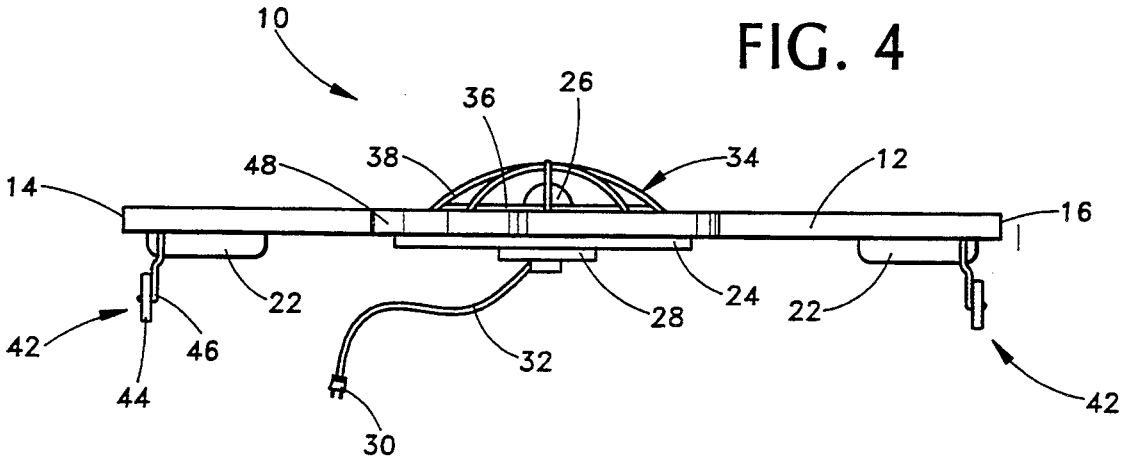
FIG. 4 is a side elevational view of the mechanic's lamp.

Referring now to the figures, a rolling mechanic's lamp 10 in accordance with the present invention is illustrated. The preferred embodiment of the lamp 10 includes a rectangular frame member 12 having opposing lateral ends 14 and 16, respectively. Positioned between ends 14 and 16, the frame member 12 has an opening 18 of circular shape located in the center thereof. Separate rectangular receptacles 20 are positioned remotely from the opening 18 and proximate the lateral ends 14 and 16. The bottom of each of the receptacles 20 is closed by a cupped frame extension 22 which projects beneath the frame member 12 so as to provide a convenient receptacle for small tools, nuts, bolts, and vehicle components.

The frame member 12, measuring approximately 1.5 feet (45 centimeters) in length and 1.0 feet (30 centimeters) in width, may be fabricated of a variety of materials known for their overall durability in shop environments. In this regard, wood and thermoplastic materials may be utilized. It is noted, however, that thermoplastics and other moldable materials offer the benefit of readily forming the frame extensions 22 in integral fashion with frame member 12 during manufacture. For this reason, moldable materials are preferred for producing the lamp 10 on a commercial scale.

Means for illuminating the area above the frame member 12 are positioned within the opening 18. A reflector 24 is secured to the bottom of the frame member 12 so as to cover the bottom of the opening 18. Preferably, the reflector 24 is a fiat, metallic disk having a polished upper surface for reflecting light upwardly therefrom. It is contemplated, however, that the reflector 24 may be provided with a parabolic or curved configuration so as to provide a higher intensity light to the illuminated area. A number of curved reflectors which may be utilized in the present invention are illustrated in U.S. Pat. No. 4,344,111, issued to Alan J. Ruud et al on Aug. 10, 1982, which is hereby incorporated by reference to illustrate this particular feature.

An electric bulb 26, fitted within a well-known electrical socket 28, is supported by the reflector 24 within the opening 18. The socket 28 is electrically coupled to a connecting plug 30 by means of an insulated wire 32, which extends along the underside of the reflector 24 and frame member 12. A suitable extension cord (not shown) may be used to connect the plug 30 to a power outlet provided, for example, in the wall of an automotive garage. Further, an electrical switch (not shown) may be provided at any point between the socket 28 and the plug 30 for selectively energizing the bulb 26 without resort to physically disconnecting the plug 30 itself from the electrical power source.

The bulb 26, may be of either fluorescent or incandescent type. Regardless of type, however, it is preferable to use a bulb which emits little heat energy and provides substantially cool illumination without the chance of burns or other injury to users. As the top of opening 18 permits the free circulation of air, the heat which may be developed in the region of the bulb 26 may be readily carried away thereby reducing the risk of personal injury or fire.

A cage 34 of openwork wire construction is secured to the top of the frame member 12 and is disposed above the opening 18 to protect the relatively fragile bulb 26 from damage. The cage 34 includes a circular ring 36 closely fitted about the periphery of the opening 18 and a number of arches 38 extending upwardly therefrom. The arches 38 have their respective lower ends joined to the ring 36 in a spaced-apart relationship and their respective upper ends joined together at a point 40, a predetermined height above the opening 18, to form a dome-shaped cover for the bulb 26. In the preferred embodiment, the spacing between each of the arches 38 is sufficiently large to pass the bulb 26 therethrough for replacement. Nevertheless, it is contemplated that the cage 34 may be removably secured to the frame member 12 in a well-known manner so that a bulb of relatively larger size may used in conjunction with the present invention.

Casters 42, comprising small wheels 44 set on pivoting supports 46, are provided beneath the frame member 12 for facilitating rolling movement of the lamp 10. A caster 42 is secured to each of the four corners of the frame member 12 for optimum stability and ease of movement. To facilitate this movement, a C-shaped handle 48 is joined to one side of the frame member 12 between the lateral ends 14 and 16. The handle 48 may be readily grasped by the human hand.

From the foregoing, the manner of use of the lamp 10 should be apparent to one reasonably skilled in the art. However, when the mechanic desires to illuminate a given portion of an automobile undercarriage, he merely needs to energize the bulb 26 by way of connecting the plug 30 to an electrical current source. By grasping the handle 48, the lamp 10 may be rolled over a floor surface on casters 42 to any desired position. Any tools or vehicle components placed in the article carrying receptacles 20 are readily available for use. If desired, the lamp 10 may be lifted or suspended by the handle 48 to provide high-intensity lighting to an area remote from a floor surface.

It is to be understood that the present invention may be embodied in other specific forms and is not limited to the sole embodiment described above, but encompasses any and all embodiments within the spirit and scope of the following claims. Therefore, the present embodiment must be considered in all respects as illustrative only.

We claim:

1. A rolling mechanic's lamp, comprising:

a rectangular frame member having a centrally located, circular opening and at least one receptacle remote therefrom for article carrying purposes;

a reflector secured to said frame member in said centrally located circular opening for directing light through the top of said centrally located circular opening;

an electric bulb supported by said reflector within said centrally located circular opening for illuminating the area above said frame member;

a cage secured to the top of said frame member and disposed above said electric bulb, said cage further including a ring fitted about the periphery of said opening and a plurality of arches having first and second ends, each of which are joined to said ring in a spaced apart relationship;

a caster secured to each of the four corners of said frame member; and a handle joined to said frame member adapted for grasping by the human hand.

2. The rolling mechanic's lamp as described in claim 1, wherein said handle is C-shaped and is joined to one side of said frame member.

3. The rolling mechanic's lamp as described in claim 2, further comprising a pair of receptacles, each of which has a cupped frame extension projecting beneath said frame member, said pair of receptacles being positioned on opposite sides of said centrally located circular opening.

4. The rolling mechanic's lamp as described in claim 3, wherein said reflector further comprises a flat, metallic disk having a polished upper surface, said reflector being secured to a bottom surface of said frame member.

* * * * *